219-121 SR
1/23/79 XR 4,136,298

United States Patent [19]
Hansler

[11] 4,136,298
[45] Jan. 23, 1979

[54] ELECTRODE-INLEAD FOR MINIATURE DISCHARGE LAMPS

[75] Inventor: Richard L. Hansler, Pepper Pike, Ohio

[73] Assignee: General Electric Company, Schenectady, N.Y.

[21] Appl. No.: 900,612

[22] Filed: Apr. 27, 1978

Related U.S. Application Data

[63] Continuation-in-part of Ser. No. 824,557, Aug. 15, 1977, abandoned.

[51] Int. Cl.[2] ..... H01J 61/06
[52] U.S. Cl. ..... 313/217; 174/50.61; 219/121 LM; 313/331; 29/25.11; 174/50.64
[58] Field of Search ..... 313/217, 331; 219/121 L, 121 LM; 174/50.64, 50.61, 94 R; 29/25.11

[56] References Cited

U.S. PATENT DOCUMENTS

| | | | |
|---|---|---|---|
| 3,639,722 | 2/1972 | Pagnotta et al. | 219/127 |
| 3,701,921 | 10/1972 | Wiedenmann | 313/332 |
| 3,804,529 | 4/1974 | Hansler | 356/167 |

*Primary Examiner*—Rudolph V. Rolinec
*Assistant Examiner*—Darwin R. Hostetter
*Attorney, Agent, or Firm*—Ernest W. Legree; Lawrence R. Kempton; Frank L. Neuhauser

[57] ABSTRACT

An electrode-inlead assembly comprises a small tungsten pin which is joined on axis to a fine molybdenum wire adapted to sealing through fused silica. The join is effected by a laser butt weld which permits a symmetric compact seal thereby making possible very small discharge envelopes having minimum end losses. The seal may be effected either by a foliated portion in the wire which is wetted by fused silica, or by a glass bead formed around the wire which wets both wire and fused silica.

11 Claims, 5 Drawing Figures

*Fig. 1*

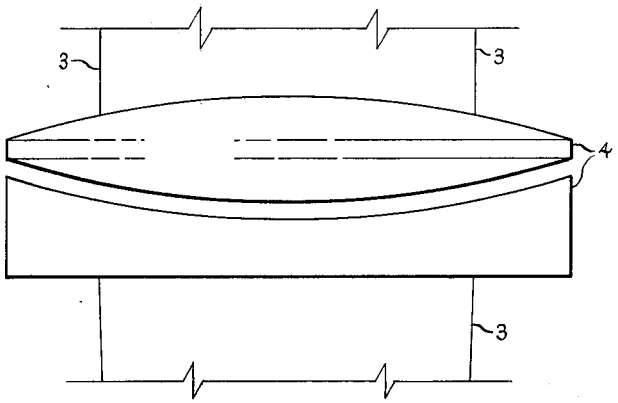
Fig. 1
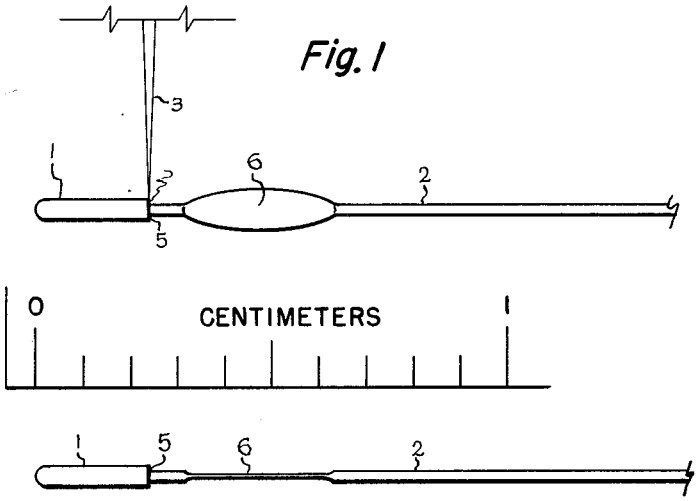
Fig. 2
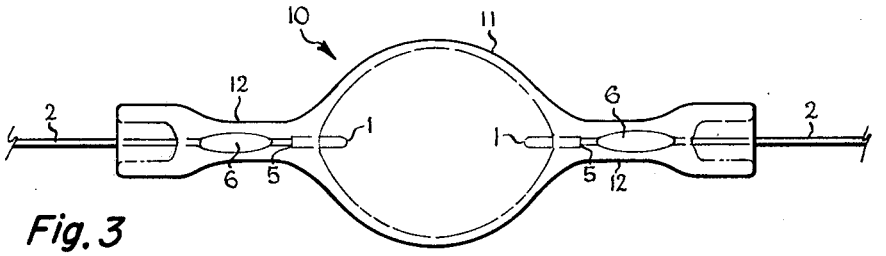
Fig. 3
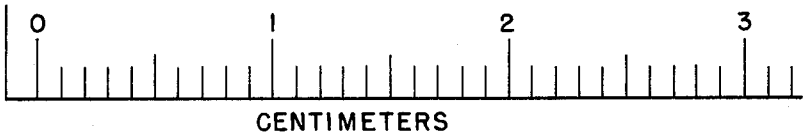

ELECTRODE-INLEAD FOR MINIATURE DISCHARGE LAMPS

This application is a continuation-in-part of my copending application Ser. No. 824,557, filed Aug. 15, 1977, similarly titled and assigned and now abandoned.

The invention relates to an electrode-inlead assembly particularly suitable for use in metal vapor discharge lamps having very small discharge volumes such as about 1 cubic centimeter or less.

BACKGROUND OF THE INVENTION

In the pending application of Daniel M. Cap and William H. Lake, Ser. No. 812,479, filed July 5, 1977, entitled High Pressure Metal Vapor Discharge Lamps Improved in Efficiency and assigned like this application, new miniature discharge lamps having envelope volumes of about 1 cubic centimeter or less are disclosed. These lamps have ratings starting at about 100 watts and going down to less than 10 watts, and characteristics including life-durations making them suitable for general lighting purposes. They are wall-stabilized and may utilize fillings comprising mercury and metal halides. In them the input wattage is reduced, while ratios of arc watts to electrode watts similar to those in larger sizes of lamps are maintained by increasing the mercury vapor pressure at the same time as the discharge volume is decreased. In larger conventional sizes of lamps, convective instability of the arc sets a limit on mercury vapor pressure. But by going to a small envelope, one cubic centimeter in volume or less, it becomes possible to increase mercury vapor pressure severalfold while yet avoiding convective instability. However it is necessary to maintain the desired electrode temperature with the reduced energy input, and that must be achieved primarily by reducing the physical size of the electrodes and inleads in order to reduce the heat loss from them.

SUMMARY OF THE INVENTION

The object of the invention is to provide an electrode-inlead construction particularly adapted to use with miniature discharge lamps in order to reduce electrode heat loss.

According to the invention, an electrode-inlead assembly comprises an electrode having a pin-like root end of refractory metal which is butt-welded, that is joined on axis, to a fine refractory metal wire adapted for sealing into a vitreous envelope. In one embodiment of the invention, the metal wire is provided with a flattened or foliated portion for sealing through vitreous envelope material, suitably fused silica. It is impractical to make butt welds between fine wires of refractorymetals using conventional electrical percussive welding. I have found that the join can be effected by a laser weld which permits the foliated portion to begin very close thereto, even within less than 1 millimeter. This makes possible very small discharge envelopes having proportionately small necks in which the electrode-inlead assemblies of the invention are sealed. In a preferred construction of this embodiment, the refractory metal pin which forms the electrode is tungsten and the foliated fine wire inlead is molybdenum.

In another embodiment of the invention, the metal wire inlead portion has a bead of glass formed around and wetting the wire, and the hermetic seal is effected by causing fused silica from the neck to shrink around the bead and be wetted by it. In accordance with the invention the join between the electrode portion and the wire inlead portion is effected by a laser weld on axis.

DESCRIPTION OF DRAWINGS

In the drawings:

FIGS. 1 and 2 are enlarged side and plan views respectively, to the scale shown between them, of an electrode-inlead assembly embodying the invention and utilizing a foliated portion for sealing.

FIG. 3 illustrates, to the scale shown below the figure, a miniature discharge lamp in which two of the electrode-inlead assemblies of FIGS. 1 and 2 are included.

DESCRIPTION OF PREFERRED EMBODIMENTS

Figure 4:
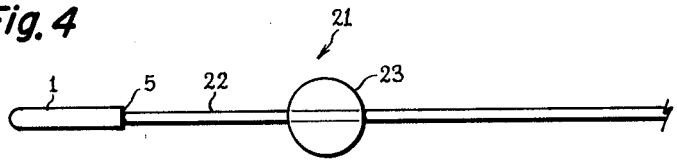
FIG. 4 is an enlarged view of an electrode-inlead assembly embodying the invention and utilizing a glass bead for sealing.

Referring to FIGS. 1 and 2, the assembly comprises a tungsten pin 1 of 0.38 mm diameter (0.015") which may be about 2.5 mm long joined to a fine molybdenum wire 2 of 0.20 mm diameter (0.008"). The join is effected by a laser butt weld 5 which maintains both parts on the same axis and makes a symmetric structure. A symmetric structure cannot be achieved when a lap weld is used such as has been usual in prior art foil inlead assemblies. A symmetric structure permits a seal into a quartz tube or envelope neck of smaller cross section. On account of their symmetry and greater strength, assemblies according to the invention are greatly preferred for automatic sealing.

The laser weld may be made using a neodymium-doped yttrium aluminum garnet laser, commonly termed a YAG laser, suitably of 20 joules capacity. A YAG laser rod emits infrared light of 1.06 microns which may be absorbed up to 20% depending on the metal to which it is applied and the extent to which the metal is melted. Referring to FIG. 1, the beam 3 from the laser head (not shown) is guided through an optical focusing system including objective lens 4 and is focused near the juncture 5 of tungsten pin and molybdenum wire. Only interrupted portions of the beam 3 have been illustrated in order to compress the drawing while maintaining the scale. The spot size may be adjusted to give a very narrow fusion zone, for instance 0.2 mm (0.008"), and the energy content of the pulse set to melt the metals without causing excessive vaporization. The pin and wire are pressed axially together and upset slightly during the welding to replace any vaporized metal.

The foliated portion 6 in the molybdenum wire begins very close to the laser weld 5, within 2 millimeters or less. In the illustrated embodiment the foliated portion begins within less than 1 millimeter from the weld. The foliated portion is about 3.5 mm long by 0.9 mm wide and has a thickness of about 0.015 mm (0.0006"). It is conveniently produced by swaging or by rolling. It may be made before the weld; however, because the laser weld is strong and not brittle as conventional electrical welds would be, it may also be made after the weld. The use of a laser weld thus provides flexibility in processing the inleads.

FIG. 3 illustrates a miniature metal halide lamp or arc tube 10 using the electrode-inleads of the invention. The bulb portion 11 may be formed by the expansion and upset of relatively thin-walled quartz tubing while heated to plasticity and revolving in a double-chuck glass lathe, and the neck portions 12 by allowing the quartz tubing to neck down through surface tension. The root ends of the tungsten electrodes 1 and the laser welds 5 to the molybdenum inleads are embedded in the fused silica and this assures adequate rigidity. In the process of sealing in the electrodes, the flattened or foliated portions 6 are wetted by the fused silica of the necks and this assures hermetic seals. A suitable filling for the envelope comprises argon at a pressure of several torr to serve as starting gas, and a charge comprising mercury and one or more metal halides, for instance NaI, $ScI_3$ and $ThI_4$.

By referring to the centimeter scale shown below the lamp envelope in FIG. 3, it is readily seen that the laser-welded electrode-inleads of my invention make possible very compact seals wherein the distance from the weld 5 to the foil portion 6 where the sealing region of the neck begins may be even less than 1 millimeter.

FIG. 4 illustrates another electrode-inlead construction embodying the invention which avoids the need for a foliated sealing portion in the inlead. The assembly 21 comprises a tungsten pin or wire portion 1 of 0.38 mm diameter (0.015") joined to a fine molybdenum wire 22 of 0.20 mm diameter (0.008") having a small glass bead 23 formed around it. In accordance with the invention, the join between the two parts is effected by a laser butt weld 5 which maintains both parts on the same axis. As previously described, this permits making a symmetric structure which facilitates a seal of small cross section as needed for efficacy in a miniature metal vapor lamp.

Figure 5:
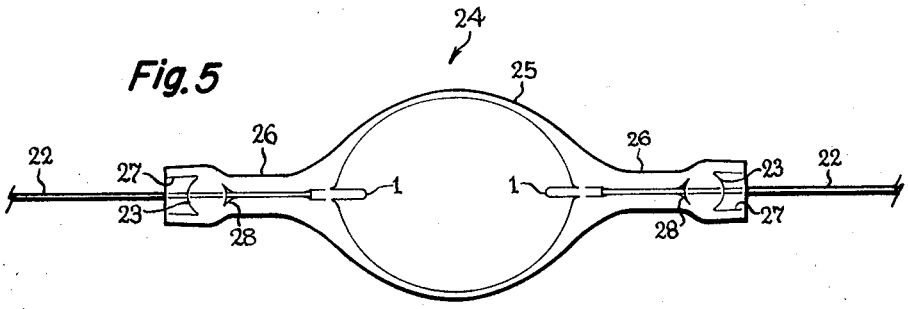
FIG. 5 illustrates a miniature discharge lamp utilizing the electrode-inlead assembly of FIG. 4.

In order to make a lamp or arc tube 24 with the electrode-inlead of FIG. 4, one may proceed as follows, utilizing the teachings of copending application Ser. No. 895,433, filed Apr. 11, 1978 by Robert F. Holle and Richard L. Hansler, titled Fused Silica Lamp Envelope and Seal and assigned like this application. Referring to FIG. 5, when quartz bulb 25 was formed, a neck 26 was provided having a hole or passage through it larger than the tungsten electrode 1 over a length of several millimeters. Beyond, the hole is larger than the bead and the neck may flare out to the original tubing dimensions exceeding that indicated at 27. The neck is made long enough to locate the bead at some distance from the bulb. If the glass bead is sealed into the quartz too close to the bulb it may soften during operation of the lamp.

Prior to inserting the tungsten inlead into the neck, a small bead 23 of glass is formed on the tungsten wire. A glass is used having a coefficient of thermal expansion intermediate that of tungsten and of fused silica. One suitable glass is Corning glass No. 7230 having an expansion coefficient of about $1.4 \times 10^{-6}$ per °C., which compares with tungsten at $4.5 \times 10^{-6}$ and quartz at $0.45 \times 10^{-6}$. Other suitable glasses are the General Electric Company series GSC 1 to 3. A suitable method of forming the bead on the wire which assures wetting of the tungsten by the glass is to heat the wire in an inert atmosphere by the passage of current through it and to melt the glass onto the hot wire. It is desirable to have the bead diameter appreciably greater than the wire inlead diameter, 3 times or more. For example with the illustrated inlead which is 8 mil molybdenum wire, a bead of 40 mils diameter was used. This permits some radial distance or annular separation between the point where the glass is sealed to the silica and the point where it is sealed to the inlead.

To make the seal, the beaded wire inlead is inserted into the neck and argon flushing gas may be used to force the bead into the throat of the flare. The seal is completed by heating the quartz neck by means of a sharp gas flame, starting with the flame next to the bulb and moving out towards the glass bead. The entire assembly is of course revolving in a glass lathe while heat is being applied. Sufficient heat is applied to soften the quartz or fused silica and to cause it to shrink slightly in diameter and to contract around the tungsten electrode 1 and the molybdenum inlead 22 but without sealing or wetting to either. However in the region of the glass bead 23, the glass melts enough to wet the quartz as the latter contracts about the bead. This assures a hermetic seal inasmuch as there is wetting between glass and tungsten inlead and between glass and quartz surrounding it.

The heating is controlled to maintain an annular gap or crevice 28 around the inlead between the sealing zone of quartz to glass, and the sealing zone of glass to metal inlead. In other words the heating is restrained to avoid a complete collapse of the quartz against the inlead next to the glass bead which would obliterate crevice 28 on the bulb side of the glass lead. The annular crevice 28 may fill with inert gas or with some of the mercury and metal halide charge during the life of the lamp; however it is small enough that this creates no problem from the point of view of changing the amount of the effective charge in the bulb.

In either the lamp of FIG. 3 or that of FIG. 5, the charge of mercury and metal halide may be introduced into the arc chamber through one of the necks before sealing in the second electrode, in which case the arc chamber portion is chilled during the heat sealing of the neck to prevent vaporization of the charge. Alternatively, the charge may be introduced through an auxiliary exhaust tube after the electrodes have been sealed in and the exhaust tube (not shown) is then eliminated by tipping off.

What I claim as new and desire to secure by Letters Patent of the United States is:

1. An electrode-inlead assembly comprising an electrode having a pin-like root end of refractory metal joined on axis to a fine refractory metal wire inlead having a foliated portion therein, the join being effected by a laser weld.

2. An electrode-inlead assembly as in claim 1 wherein the electrode is tungsten and the inlead is molybdenum.

3. An electrode-inlead assembly as in claim 1 wherein the distance from the laser weld to the beginning of the foliated portion does not exceed 2 millimeters.

4. An electrode inlead assembly as in claim 3 wherein said distance does not exceed 1 millimeter.

5. A miniature high pressure metal vapor discharge lamp comprising a thin-walled vitreous envelope defining a discharge space not exceeding approximately 1 cubic centimeter in volume and a pair of tungsten electrodes therein having pin-like root ends, said envelope having slender necks through which extend refractory metal inleads laser butt-welded to said electrode ends and including foliated portions hermetically sealed therein whereby to achieve minimum end losses.

6. A miniature discharge lamp as in claim 5 wherein the distance between the laser butt weld and the start of the foliated portion does not exceed 2 millimeters.

7. A lamp as in claim 6 wherein said distance does not exceed 1 millimeter.

8. An electrode-inlead assembly comprising an electrode having a pin-like root end of tungsten joined on axis to a fine refractory metal wire inlead having means adapting it to make a seal through a fused silica part, the join being effected by a laser weld.

9. An electrode inlead assembly as in claim 8 wherein said means comprises a bead of glass formed around the refractory metal wire inlead with wetting of same, said glass having a coefficient of thermal expansion intermediate that of said refractory metal and that of fused silica.

10. An electrode-inlead assembly as in claim 9 wherein the inlead is molybdenum and the coefficient of thermal expansion of said glass is intermediate that of molybdenum and that of fused silica.

11. A miniature high pressure metal vapor discharge lamp comprising a thin-walled fused silica envelope having a bulb portion defining a discharge space not exceeding approximately 1 cubic centimeter in volume and a pair of tungsten electrodes therein having pin-like root ends, said envelope having slender necks through which extend refractory metal wire inleads laser butt-welded to said electrode ends, each of said inleads having a bead of glass formed around the wire with wetting of same, said glass having a coefficient of thermal expansion intermediate that of said refractory metal and that of fused silica, the neck being contracted around the inlead without wetting it substantially from the bulb portion to the glass bead and being contracted around and wetted by said glass bead in order to achieve a hermetic seal at that point.

* * * * *